US005845414A

United States Patent [19]

Ohsugi

[11] Patent Number: 5,845,414

[45] Date of Patent: Dec. 8, 1998

[54] DRYING EQUIPMENT WITH RETRACTABLE ROD CLIPS

[75] Inventor: Yasuhiro Ohsugi, Hiroshima, Japan

[73] Assignee: NKG Co., Ltd., Hiroshima, Japan

[21] Appl. No.: 825,555

[22] Filed: Mar. 19, 1997

[30] Foreign Application Priority Data

Apr. 15, 1996 [JP] Japan ..... 8-092779
Jun. 14, 1996 [JP] Japan ..... 8-154461

[51] Int. Cl.[6] ..... F26B 25/00

[52] U.S. Cl. ..... 34/239; 223/90; 211/197

[58] Field of Search ..... 34/103, 104, 106, 34/239, 240; D23/332, 314, 336; 211/197, 167, 205; 248/316.5, 231.51; 223/89, 90, 84, 85, 91

[56] References Cited

U.S. PATENT DOCUMENTS 5,405,065 4/1995 Olson ..... 223/90
5,449,075 9/1995 Meade et al. ..... 211/197

FOREIGN PATENT DOCUMENTS 747193 2/1995 Japan .
7204390 8/1995 Japan .
7328283 12/1995 Japan .
76271 7/1975 Taiwan .
235635 12/1994 Taiwan .

*Primary Examiner*—Henry A. Bennett
*Assistant Examiner*—Steven Gravini

[57] ABSTRACT

Drying equipment including a plurality of drying arms radially expanded around a body. Each drying arm has a clip for clipping and fixing the washing, and the clip is released by operating a constraining part in liaison with rotation for folding the drying arm in a reverse direction to the rotation for expanding the drying arm. Thus, fixation with the clip can be easily released, and the washing hung on the drying arms can be easily taken in.

22 Claims, 15 Drawing Sheets

DRYING EQUIPMENT WITH RETRACTABLE ROD CLIPS

BACKGROUND OF THE INVENTION

1. Field of the Invention

The present invention relates to drying equipment for drying washing such as washed clothes in a limited space.

2. Description of Related Art

Various types of drying equipment for drying washing, particularly diapers, underwear and small articles such as towels, in a limited small space have conventionally been proposed. One type of such various drying equipment widely used comprises a body having a suspending part at a substantially center of its one face and a plurality of drying arms which can radially expand from the periphery of the body.

This drying equipment is hung on an object for suspension such as a clothes-drying bar with the face having the suspending part facing upward by using the suspending part, so that the washing such as washed clothes are caught by the respective drying arms. In the usage of this drying equipment, the washing caught by the drying arms is held in a circular space having the body as its center and a radius equal to the length of each drying arm. In addition, an appropriate space can be retained between the adjacent washing, so that airing among the washing cannot be interfered and a drying efficiency cannot be degraded. Thus, this type of drying equipment has a number of advantages.

Furthermore, this type of drying equipment is practically used because various devices for improving its convenience are made. For example, the respective drying arms are pivoted on the body at their base portions. Therefore, the drying arms can be respectively rotated around the pivots, so as to be folded and collected with their tips aligned below the center of the body, when the drying equipment is not in use. Thus, the drying equipment can be easily stored. Moreover, each drying arm can be provided with an integrated clip at its tip portion, so that the washing can be clipped and fixed with the clip. Therefore, the washing can be prevented from moving or dropping in the wind during the usage of the drying equipment.

However, the drying equipment has also a disadvantage. The washing caught on the respective drying arms of the drying equipment are clipped and fixed with the clips of the drying arms described above or other clipping gigs such as a clothes-pin for preventing them from moving and coming off from the drying arms during the usage. Accordingly, when the washing have been dried and are to be taken in, the respective clips of the drying arms should be released, which disadvantageously takes time and is troublesome.

BRIEF SUMMARY OF THE INVENTION

The present invention was devised to overcome the aforementioned disadvantage, and the object is providing drying equipment in which clips on plural drying arms radially expanded around a body can be easily released so as to overcome the inconvenience in taking the washing in.

The drying equipment of this invention comprises a body having a suspending part disposed at substantially a center of one face thereof for suspending the drying equipment on an object for suspension with the face facing upward; a plurality of drying arms, each for hanging the washing, a base portion of each drying arm being pivoted on a periphery of the body and a tip portion of each drying arm being radially expanded through rotation of the drying arm with a pivot as a rotation center; a clip disposed at the tip portion of each drying arm for clipping and fixing the washing between the clip and the drying arm; and constraining means for constraining each clip in a clipping state in liaison with the rotation of the corresponding drying arm in an expanding direction and for releasing constraint of the clip in liaison with the rotation of the drying arm in a reverse direction.

In this drying equipment, the clip, which is provided on each drying arm for clipping and fixing the washing in the use state where the plural drying arms are expanded, can be released through the operation of the constraining means linked with the rotation for folding the drying arms in the reverse direction to the rotation for expanding them. Accordingly, when the washing is desired to be taken in, the washing hung on the respective drying arms can be easily taken in by merely folding the respective drying arms.

In one aspect of the drying equipment, the constraining means includes an auxiliary arm whose base portion is pivoted in a position lower than the pivot of each drying arm and whose tip portion is supported by being inserted through a guide portion formed at the tip portion of the drying arm, the clip in a U-shape being disposed with one end thereof pivoted on the tip portion of the auxiliary arm, and each auxiliary arm is rotated on the same plane as the corresponding drying arm and moved in a lengthwise direction in accordance with the rotation of the drying arm, the clip is drawn into the guide portion and the other end of the clip is brought to elastic contact with an upper face of the tip portion of the drying arm for the constraint through the rotation in the expanding direction, and the clip is pushed out of the guide portion and the constraint is released through the rotation in the reverse direction.

In this drying equipment, the constraining means simply includes the auxiliary arms each of which is pivoted at its base portion on the periphery of the body, is inserted through and supported by the guide portion provided at the tip portion of the corresponding drying arm, and has the clip in the U-shape whose one end is pivoted on its tip portion.

Each of the auxiliary arms is rotated in accordance with the rotation of the corresponding drying arm. When the drying arm is rotated to be expanded, the auxiliary arm is drawn into the guide portion, and when the drying arm is rotated in the reverse direction, the auxiliary arm is pushed out of the guide portion. When the auxiliary arm is drawn into the guide portion, the clip in the U-shape disposed at the tip portion of the auxiliary arm is rotated while one side of the U-shape is being drawn into the guide portion, so as to be constrained in a state where the other side is in elastic contact with the upper face of the drying arm. Therefore, the washing hung on the drying arm can be clipped and fixed by being sandwiched between the drying arm and the clip. The clip is moved away from the drying arm when the auxiliary arm is pushed out of the guide portion, so as to be freely rotatable at the tip portion of the auxiliary arm. Therefore, the clip does not interfere in taking in the washing having been dried on the drying arm.

In still another aspect of the drying equipment, the body includes operation means for expanding part or all of the drying arms at a time and constraining the expanded drying arms.

In this drying equipment, part or all of the drying arms can be expanded at a time and the expanded drying arms can be constrained in the expanded state by operating the operation means provided in the body. Therefore, there is no need to expand each of the drying arms. Thus, the use state can be easily achieved. Furthermore, when part or all of the drying arms are rotated in the reverse direction to the expanding direction, namely, in the folding direction, the clips on the respective drying arms can be simultaneously released. Therefore, the washing hung on the plural drying arms can be taken in at one time. When a covering portion is provided at the tip portion of each drying arm as described below, the washing hung on the plural drying arms can be dropped simultaneously with folding the drying arms, resulting in taking in the washing at one time.

In still another aspect of the drying equipment, each of the drying arms includes an extension extended from the pivot thereof into the body, the operation means includes a push/pull rod penetrating through an upper portion of the body and extending into the body and a presser block fixed at an end of the push/pull rod within the body and being in contact with the extensions of the drying arms aligned within the body, and the drying arms are expanded in an upward direction by pressing the extensions of the drying arms in a downward direction through the presser block by pushing the push/pull rod, and when the drying arms are expanded to be located in predetermined positions, the presser block is fit between ends of the extensions of the drying arms, thereby constraining the drying arms by using friction between the ends of the extensions and a peripheral face of the presser block.

In this drying equipment, the presser block is fixed on the end of the push/pull rod penetrating through the upper portion of the body and extending into the body. This presser block is in contact with the extensions of the drying arms extending into the body and aligned in the peripheral direction within the body. Thus, the operation means has a simple structure.

The drying arms can be expanded by pushing the push/pull rod, so as to push the extensions of the drying arms in the downward direction through the presser block. When the push/pull rod is pushed to a predetermined position, the presser block is fit between the ends of the extensions, and the ends butt against the peripheral face of the presser block. Thus, the rotation in the reverse direction to the expanding direction can be constrained.

In still another aspect, the drying equipment further comprises a second clip disposed at the periphery of the body and brought into elastic contact with the upper face of each of the drying arms in an expanded state.

In this drying equipment, the second clip which can be brought to elastic contact with the corresponding drying arm in the expanded state is disposed at the base portion of each drying arm. Therefore, the washing hung on the drying equipment can be clipped and fixed at both the tip and base portions of the drying arm, resulting in more effectively preventing the washing from coming off from the drying arm during the usage.

In still another aspect of the drying equipment, each of the drying arms has a covering portion disposed at the tip portion thereof for covering an area on both sides of a pivoted position of the clip extending over an entire range of movement of the corresponding auxiliary arm in the lengthwise direction.

In this drying equipment, the rotation of the clips linked with the rotation of the drying arms can be effected with the both sides of the pivoted positions covered with the covering portions provided at the tip portions of the drying arms. Therefore, in taking the washing off along the drying arms, there is no possibility of being caught by the clips. Thus, the washing having been dried on the drying arms can be naturally dropped by folding the drying arms, and there is no need to conduct any other separate operation for taking the washing off from the drying arms.

In still another aspect of the drying equipment, the end of the extension of each drying arm has an arc-like shape on a plane of rotation thereof with the pivot as the rotation center and is in point-contact with a corresponding face of the presser block.

In addition, a contact point between the end of the extension of each drying arm and the presser block is located below the pivot of the drying arm, and a level difference X between the pivot and the contact point is set to satisfy the following relationship:

$$0.55R<X<0.85R$$

wherein R indicates a radius of the rotation of the end of the extension with the pivot as the rotation center.

In this drying equipment, since the end of the extension of each drying arm in contact with the presser block has the arc-like shape on the rotation plane of the drying arm, so as to be in point-contact with the presser block, the contact between the extension and the presser block can be released by applying to the drying arm a force in the reverse direction to a load applied by the washing, namely, an upward force. The release can be attained by, for example, lowering the body for supporting the drying arms and suddenly stopping it immediately after lowering, or lowering the body and pulling it upward immediately after lowering. More specifically, under the condition where the washing is hung on the respective drying arms, the suspending part projecting from the upper portion of the body is grasped so as to support the entire drying equipment, and then, an appropriate downward force is simply applied.

When such a releasing operation is conducted, an upward inertia force is applied to the washing on the respective drying arms by suddenly stopping or pulling up the body, so that the drying arms are rotated in the direction for lowering the extensions. As a result, the ends of the extensions in point-contact with the presser block are removed from the presser block. At this point, the same inertia force is also applied to the presser block, and hence, the presser block is moved upward at the same time as the removal of the ends of the extensions. Then, the extensions of the drying arms return their original positions but are not brought into contact with the presser block. Thus, the constraint is released, and the drying arms are further rotated to be folded at a time. In this manner, by conducing the releasing operation, not only all the drying arms can be folded but also the washing on the drying arms can be dropped. Therefore, when the covering portion is provided at the tip portion of each drying arm as described above, the washing on the plural drying arms can be taken in at one time.

In order to definitely retain the constraint of the drying arms against the load of the washing, it is necessary to locate the contact point between the extension and the presser block below the pivot of the drying arm so as to constrain the upward rotation of the extension owing to the load. Furthermore, in order to definitely release the constraint by the aforementioned operation, it is necessary to appropriately set the level difference X on the basis of the rotation radius R of the extension.

When the level difference X is too large, a smaller force is required for the operation for folding the drying arms, but the constraint of the drying arms can be released by a small external force (such as a wind) during the usage so as to drop the washing. In contrast, when the level difference X is too small, although the constraint of the drying arms can be definitely retained, a larger force is required for the folding operation in taking in the washing. In the present drying equipment, the proportion of the level difference X to the rotation radius R is set within the range between 0.55 and 0.85. Thus, while retaining the easiness in folding the drying arms, the constraint is prevented from being released in error during the usage of the drying equipment.

In still another aspect of the drying equipment, the suspending part includes a fixed clasping member mounted on the body; a movable clasping member pivoted at a halfway thereof on the fixed clasping member; and pressing means for pressing one side of the movable clasping member toward a tip of the fixed clasping member, and the object for suspension is grasped between the clasping members opened against a pressure applied by the pressing means.

In still another aspect of the drying equipment, the other side of the movable clasping member to be gripped for opening the clasping members is provided with a catching portion for catching the object for suspension.

This drying equipment can be definitely suspended on a bar-like object for suspension such as a clothes-drying bar by grasping the bar between the fixed clasping member and the movable clasping member. On the other hand, the drying equipment can be suspended on a lintel or the like, which cannot be grasped, by catching the lintel or the like with the catching portion disposed at the other side of the movable clasping member. Thus, the drying equipment can be used without limitation in the shape of the object for suspension.

In still another aspect of the drying equipment, the suspending part is removably mounted on the body through a supporting part for axially rotatably supporting a ground portion of the fixed clasping member.

In this drying equipment, the fixed clasping member can be axially rotated, so that the clasping part between the fixed clasping member and the movable clasping member or the catching portion disposed on the movable clasping member can be freely positioned in accordance with the position of the object for suspension. Furthermore, the suspending part, which can be damaged due to the load resulting from suspending the drying equipment, can be easily replaced.

The above and further objects and features of the invention will more fully be apparent from the following detailed description with accompanying drawings.

DETAILED DESCRIPTION OF THE INVENTION

Figure 2:
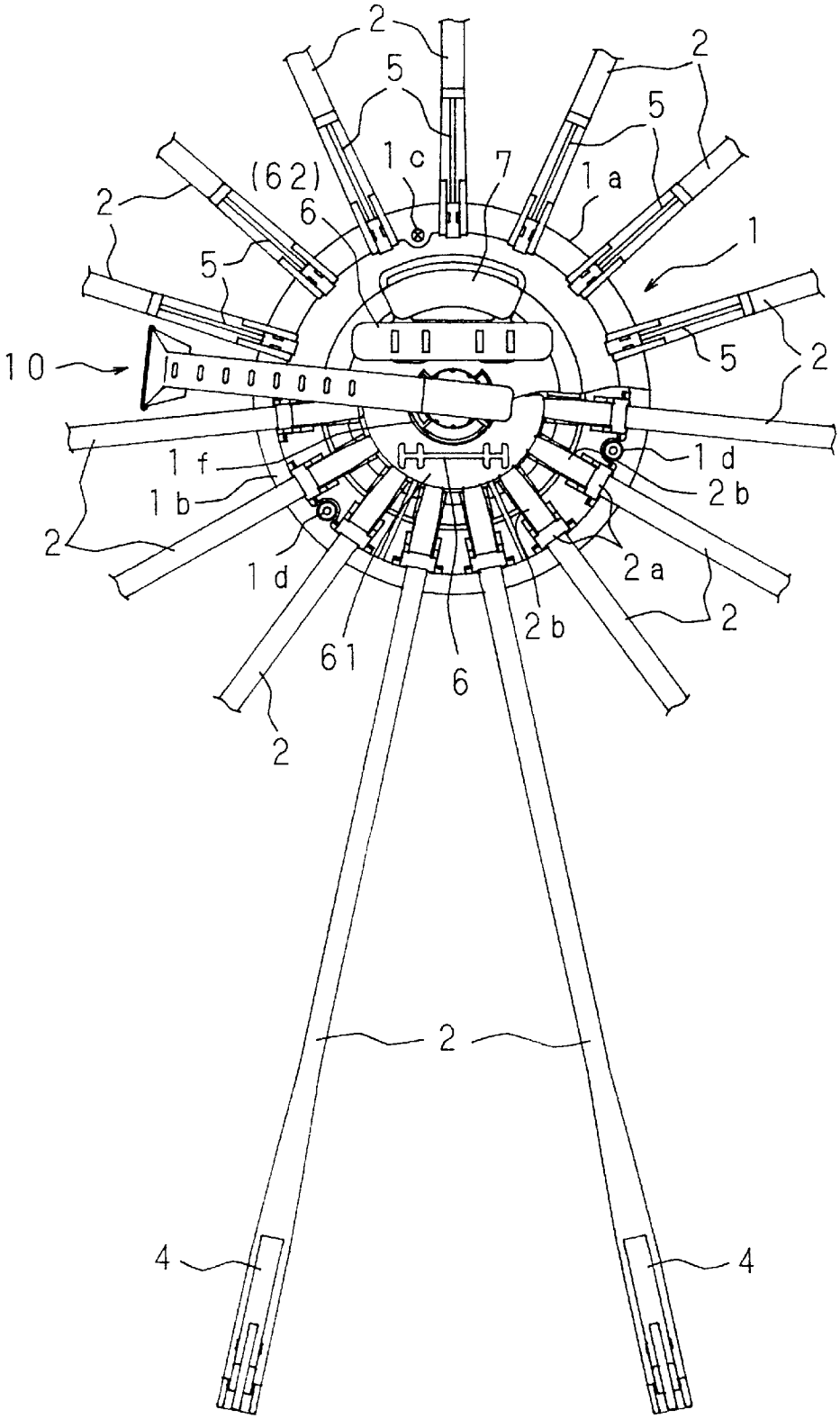
FIG. 2 is a partly exploded plan view of the drying equipment of the invention.

The present invention will now be described with reference to the accompanying drawings illustrating the embodiment thereof. FIG. I is a longitudinal sectional view for showing the entire structure of drying equipment of this invention, and FIG. 2 is a partly exploded plan view thereof.

The drying equipment of this invention comprises a body 1 having a suspending part 10 at a substantially center of one face, a plurality of drying arms 2 radially expanded around the body 1, auxiliary arms 3 provided to the respective drying arms 2, first clips 4 disposed at the tip portions of the respective auxiliary arms 3, and second clips 5 provided on the periphery of the body 1 correspondingly to the respective drying arms 2. These elements and other elements described below are all made from resin moldings of a high strength resin such as polypropylene.

The body 1 includes an upper housing 1*a* and a lower housing 1*b* both in a bowl-like shape set with their openings facing each other, and the upper housing 1*a* and the lower housing 1*b* are fixed and inseparably integrated with each other with a plurality of fixing screws 1*c* aligned in the peripheral direction. The upper part of FIG. 2 shows the top face of the upper housing 1*a,* and the lower part thereof shows the inside of the lower housing 1*b*. Merely one fixing screw 1*c* is shown in the upper part, and two screw holes 1*d* for screwing the fixing screws 1*c* are shown in the lower part.

Figure 1:
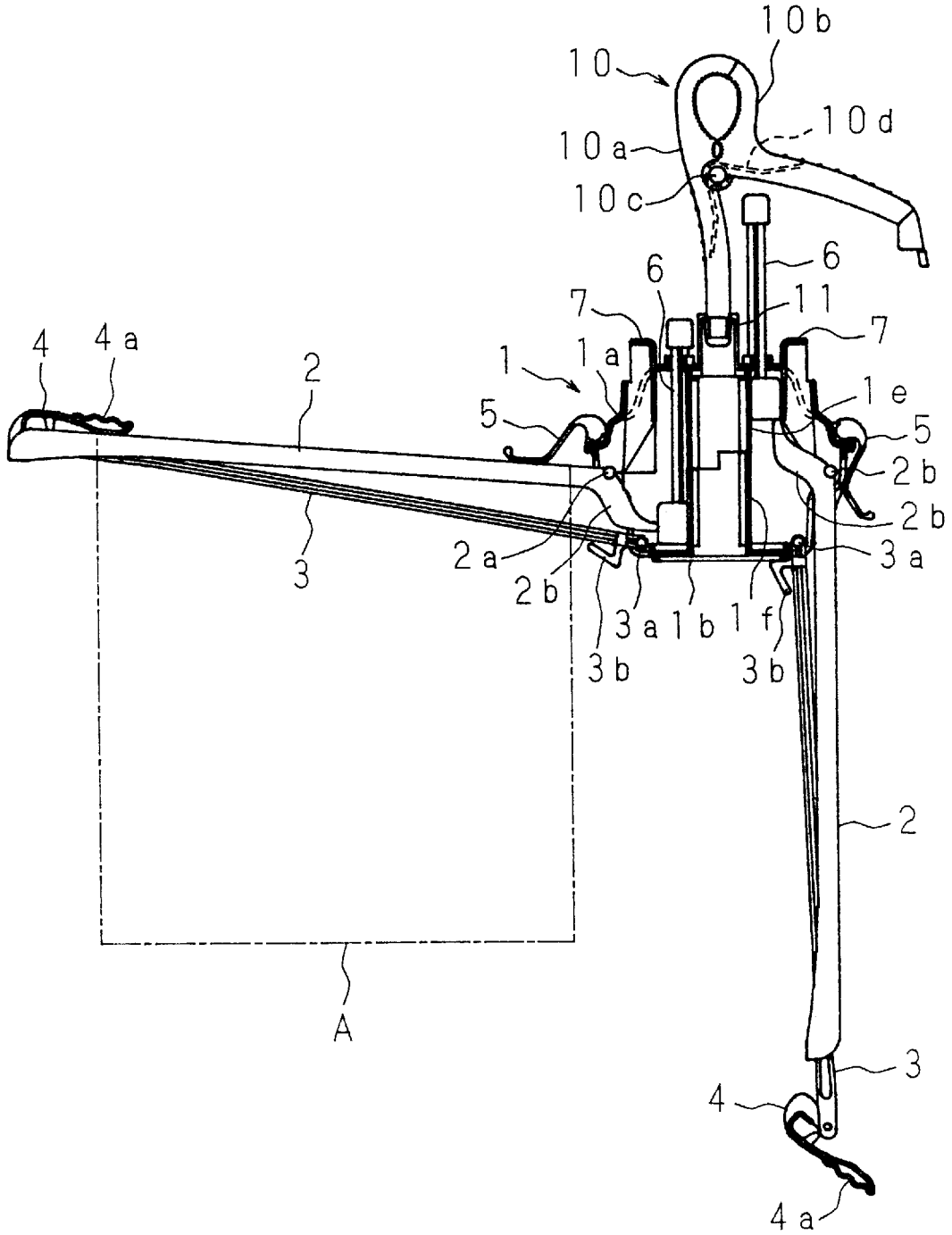
FIG. 1 is a longitudinal sectional view for showing the entire structure of drying equipment of the invention.
Figure 3:
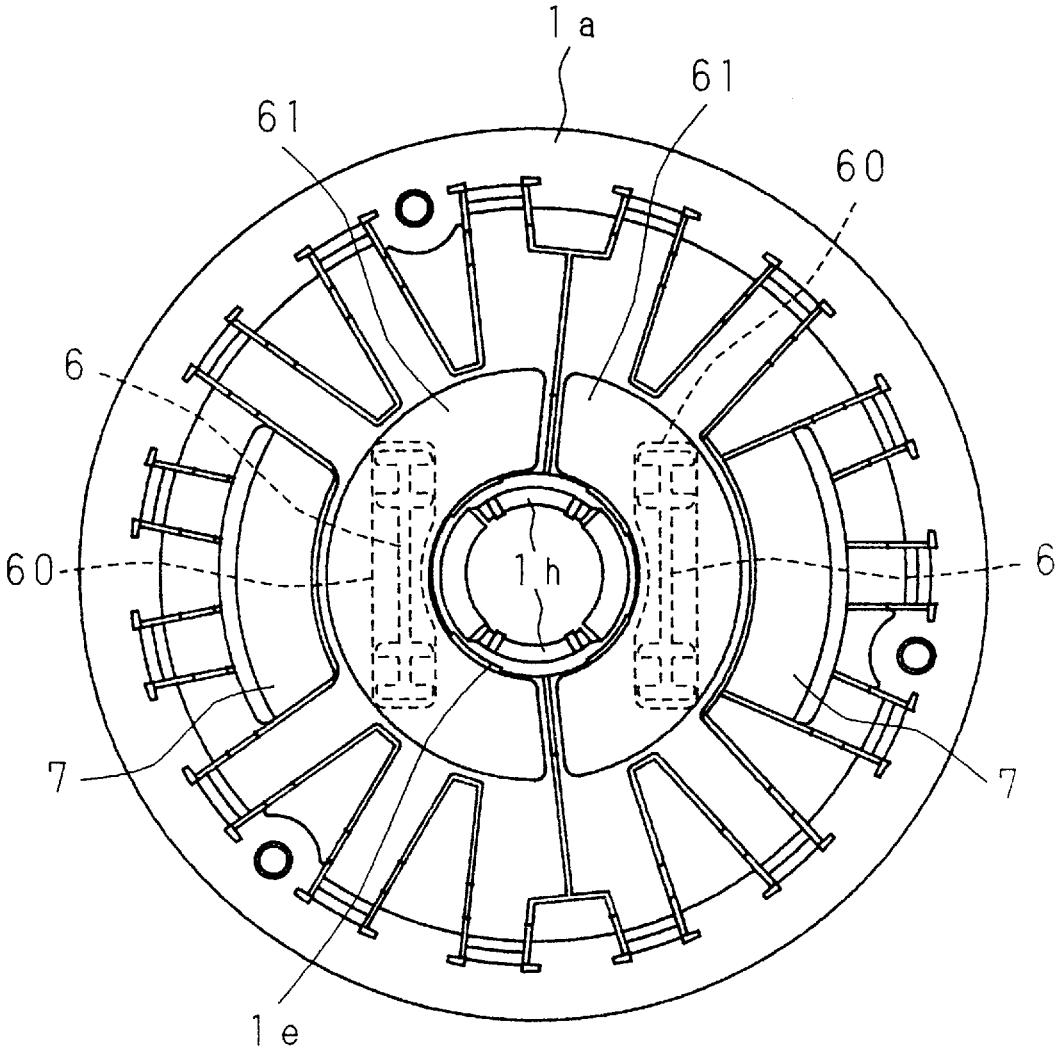
FIG. 3 is a plan view for showing the inner structure of an upper housing.

FIG. 3 is a plan view for showing the inner structure of the upper housing 1*a*. As is shown in FIG. 3 and the lower part of FIG. 2, a large number of ribs are radially formed from the centers and inside of the upper housing 1*a* and the lower housing 1*b* in order to increase the strength of the upper and lower housings 1*a* and 1*b* and support the base portions of the drying arms 2 and the auxiliary arms 3. Furthermore, the upper housing 1*a* and the lower housing 1*b* integrally include adjusting cylinders 1*e* and 1*f* having a circular section with the same diameter, respectively at the axial centers within the upper and lower housings 1*a* and 1*b*. These cylinders have stepped edges, each with a half of the circular edge chipped off, at their ends closer to each other as is shown in FIG. 1. Therefore, when the upper housing 1*a* and the lower housing 1*b* are to be integrated as described above, they can be positioned in the peripheral direction by fitting the stepped edges of the adjusting cylinders 1*e* and 1*f* with each other.

Figure 4:
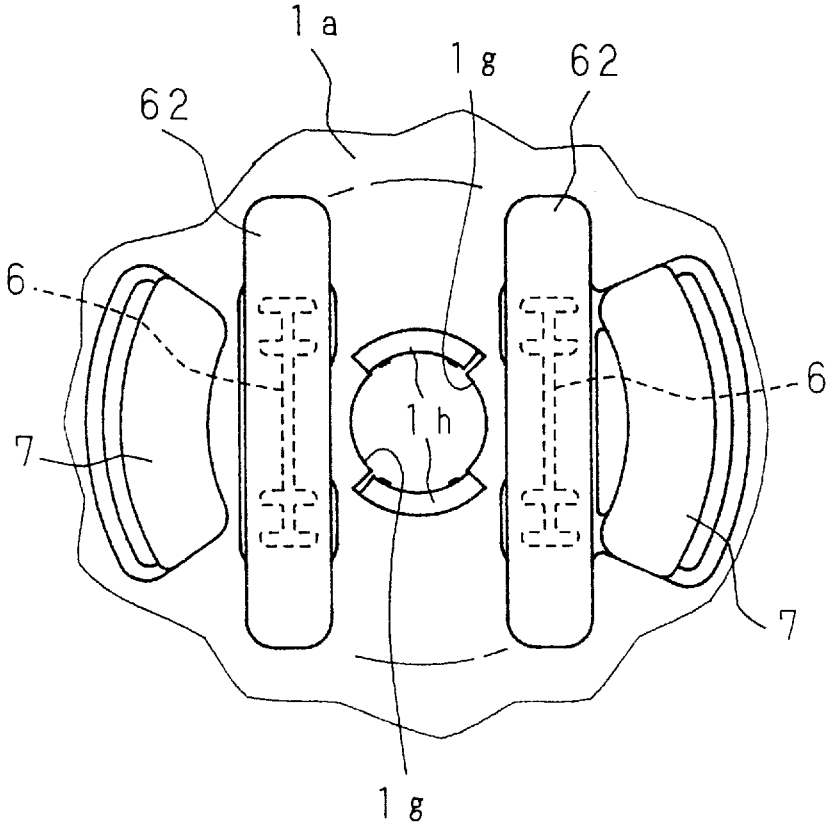
FIG. 4 is a top view of the upper housing in the vicinity of its center.

FIG. 4 is a top view of the upper housing 1*a* in the vicinity of its axial center. As is shown in FIGS. 3 and 4, on the upper edge of the adjusting cylinder 1*e* disposed on the top face of the upper housing 1*a,* a pair of engaging projections 1*g* are formed facing in the radial direction each other at the same level as the top face of the upper housing 1*a,* and a pair of engaging projections 1*h* are formed at a level slightly closer to the inside of the upper housing 1*a*. Each of the engaging projections 1*g* extends toward the center and in the peripheral direction substantially correspondingly to the quadrant of the upper edge of the adjusting cylinder 1*e*. Also, each of the engaging projections 1*h* extends similarly but not to overlap the engaging projections 1*g*. These engaging projections 1*g* and 1*h* are utilized in mounting the suspending part 10 at the center of the top face of the upper housing 1*a*.

Figure 5:
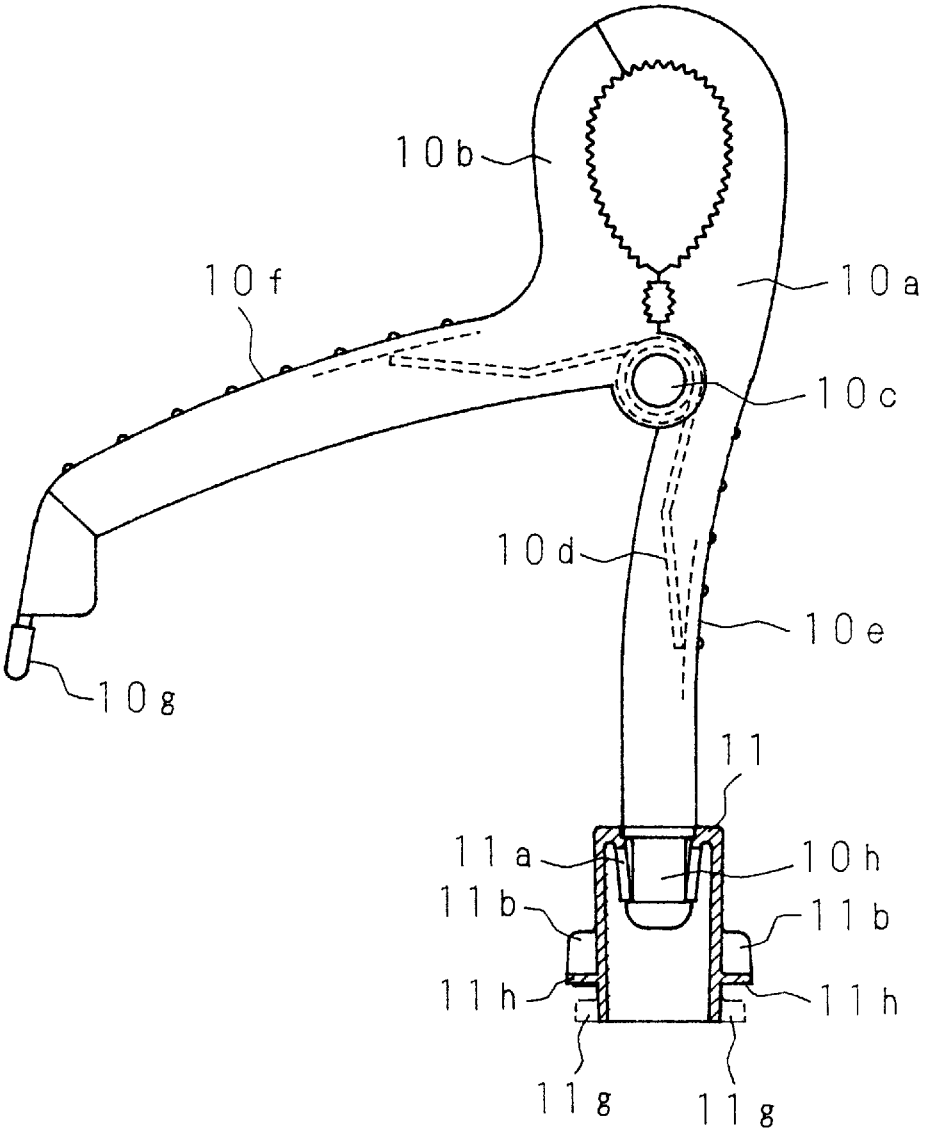
FIG. 5 is a side view for showing the structure of a suspending part.
Figure 6:
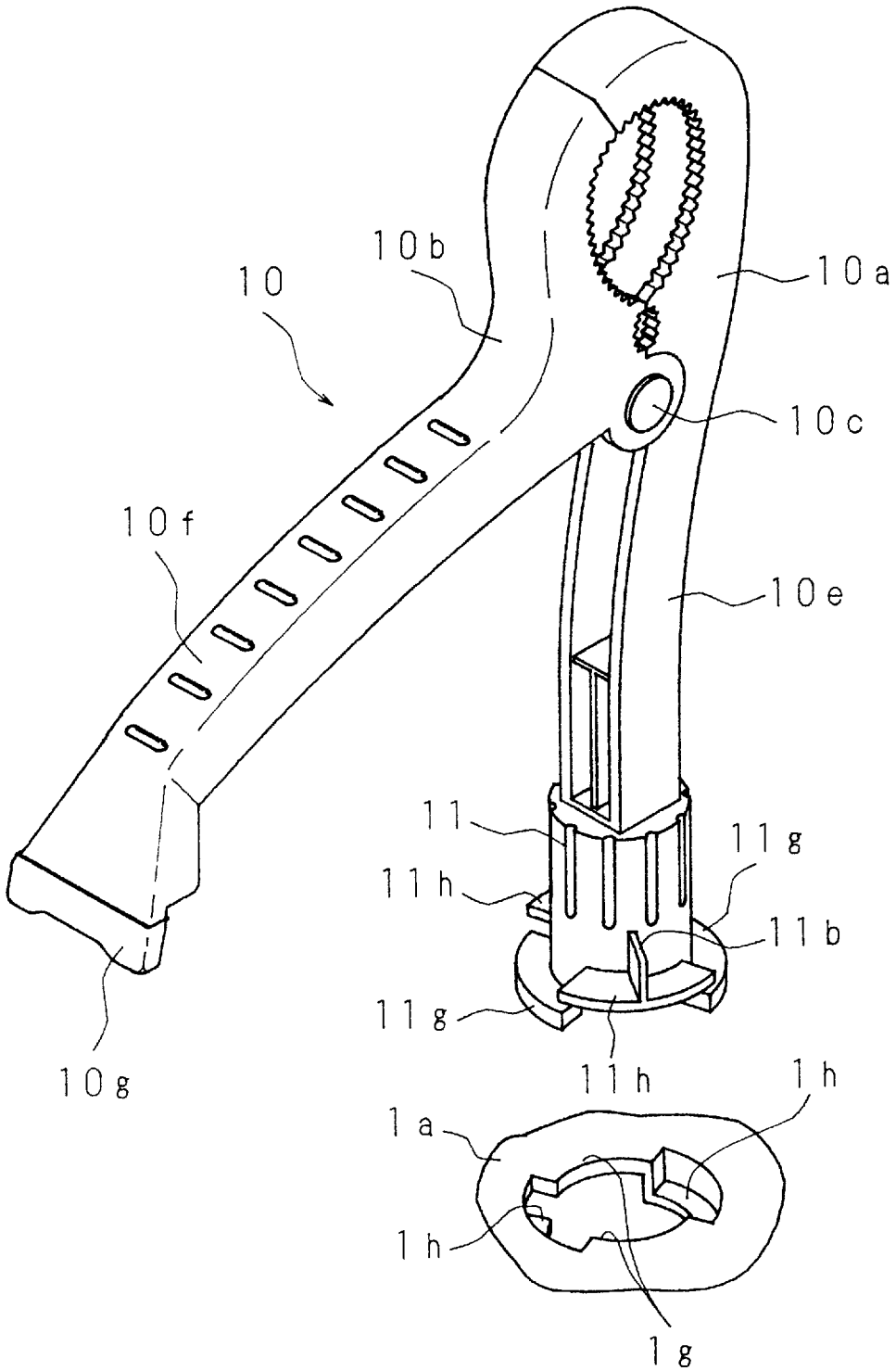
FIG. 6 illustrates mounting of the suspending part.

FIG. 5 is a side view for showing the structure of the suspending part 10, and FIG. 6 is an explanatory diagram for illustrating mounting of the suspending part 10. The suspending part 10 includes a fixed clasping member 10*a* and a movable clasping member 10*b* linked with each other at their halfway points with a pivot pin 10*c*.

Each of the fixed clasping member 10*a* and the movable clasping member 10*b* has a curved portion in a substantially arc shape on one side of the pivoted position by the pivot pin 10*c*. The fixed clasping member 10*a* and the movable clasping member 10*b* are integrally assembled so as to be supplied with a force in a direction for butting the tips of their curved portions against each other owing to a helical spring 10*d* wound around the pivot pin 10*c* as is shown in FIG. 5. On the other side of the pivoted position by the pivot pin 10*c,* the fixed clasping member 10*a* and the movable clasping member 10*b* have grip portions 10*e* and 10*f,* which are apart from each other by the spring force of the helical spring 10*d* to an extent that the grip portions 10*e* and 10*f* can be grasped with one hand. The tips of the curved portions can be opened by grasping the grip portions 10*e* and 10*f* and applying a grasping power against the spring force of the helical spring 10*d.*

The grip portion 10*f* of the movable clasping member 10*b* extends at rearly right angles to the grip portion 10*e* of the fixed clasping member 10*a* . The extended end of the grip portion 10*f* is further bent downward so as to form a catching portion with its tip covered with a non-slip cap 10*g* made of rubber. On the other hand, the grip portion 10*e* of the fixed clasping member 10*a* is extended to communicate with a joining rod 10*h* in a round pillar shape with a larger diameter at the tip. The joining rod 10*h* is axially rotatably mounted on a cylindrical supporting part 11.

The supporting part 11 has a holding cylinder 11*a,* for receiving the joining rod 10*h,* projecting inward at the axial center of one end of the supporting part 11. The holding cylinder 11*a* has a plurality of notched grooves at the peripheral face and has a slightly smaller diameter at the tip. When the joining rod 10*h* is externally pushed into the holding cylinder 11*a,* the narrow tip of the holding cylinder 11*a* is pressed and enlarged by the tip portion of the joining rod 10*h* with the larger diameter, so that the joining rod 10*h* can be inserted into the holding cylinder 11*a.* When the tip portion of the joining rod 10*h* with the larger diameter passes through the holding cylinder 11*a,* the enlarged diameter of the tip of the supporting cylinder 11*a* returns to its inherent smaller diameter, so that the joining rod 10*h* can be unremovably caught as is shown in FIG. 5. In this manner, the suspending part 10 is axially rotatably integrated with the supporting part 11.

Furthermore, the supporting part 11 has, on the peripheral face at the other end thereof, a pair of engaging projections 11*g* and a pair of engaging projections 11*h* similar to the engaging projections 1*g* and 1*h* formed around the center of the upper housing 1*a*. Each of the engaging projections 11*g* is formed at the same level as the end of the supporting part 11 so as to extend outward and in the peripheral direction substantially correspondingly to the quadrant of the supporting part 11. Each of the engaging projections 11*h* is formed at a predetermined distance from the engaging projections 11*g* so as to extend also outward but not to overlap the engaging projections 11*g*. These engaging projections 11*g* and 11*h* are shown in FIG. 6 together with the engaging projections 1*g* and 1*h* around a mounting hole on the upper housing 1*a*. Also, in FIG. 5, the engaging projections 11*h* are shown with solid lines and the engaging projections 11*g* at the same level as the end of the supporting part 11 are shown with two-dot chain lines.

The suspending part 10 thus integrated with the supporting part 11 is positioned against the mounting hole on the upper housing 1*a* with the positions of the engaging projections 11*g* according with the positions of the engaging projections 1*h* as is shown in FIG. 6. Then, the base of the supporting part 11 is inserted into the mounting hole, and the supporting part 11 is rotated along the top faces of the engaging projections 1*h* by substantially 90 degrees, so that the engaging projections 11*g* can be located below the engaging projections 1*g* around the mounting hole. Thus, the engaging projections 1*g* are sandwiched and fixed between the engaging projections 11*g* and 11*h*. At a substantially center of the top face of each engaging projection 11*h*, a fingering projection 11*b* is formed at substantially right angles to the top face and the peripheral face of the supporting part 11. Therefore, the supporting part 11 can be easily rotated, after inserting into the mounting hole, by applying a force to the fingering projections 11*b*.

In this manner, the suspending part 10 is longitudinally mounted at the axial center of the upper housing 1*a* of the body 1 as is shown in FIG. 1. Therefore, when the curved portions of the fixed clasping member 10*a* and the movable clasping member 10*b* are opened by grasping the grip portions 10*e* and 10*f*, so as to clasp a bar-like object for suspension such as a clothes-drying bar, the present drying equipment can be suspended on the bar-like object for the usage. Alternatively, the present drying equipment can be suspended on a step-like object such as a lintel with the grip portion 10*f* of the movable clasping member 10*b.* The cap 10*g* covering the tip of the grip portion 10*e* can prevent the drying equipment from coming off when thus suspended on the step-like object. Furthermore, since the suspending part 10 can be axially rotated on the supporting part 11 fixed on the upper housing 1*a* of the body 1, the drying equipment can be easily hung on the object for suspension by appropriately rotating the suspending part 10.

As is shown in FIG. 2, the fifteen drying arms 2 are mounted on the periphery of the body 1 at equal intervals in the peripheral direction. Below the drying arms 2, the corresponding number of auxiliary arms 3 are respectively disposed, and above the drying arms 2, the corresponding number of the second clips are respectively provided.

Each drying arm 2 includes a pivot 2*a* extending and projecting in the direction perpendicular to the lengthwise direction of the drying arm 2 at its base portion and an extension 2*b* extending from the pivot 2*a* in the direction toward the center of the body. The drying arm 2 is pivoted with the pivot 2*a* sandwiched between a supporting rib 12 (see FIGS. 7 through 9) projecting downward within the upper housing 1*a* of the body 1 and a supporting rib 13 (see FIG. 9) projecting upward within the lower housing 1*b*, and with the extension 2*b* extending toward the inside of the body 1, so as to be rotatable with the pivot 2*a* as the rotation center.

Each auxiliary arm 3 includes a pivot 3*a* extending in the same direction as the pivot 2*a* of the drying arm 2 at its base portion inserted into the body 1, and is also pivoted with the pivot 3*a* supported by a supporting rib 14 (see FIGS. 7 through 9) projecting from the bottom of the lower housing 1*b*, so as to be rotatable with the pivot 3*a* as the rotation center on the same plane as the drying arm 2. The tip portion of the auxiliary arm 3 is inserted through the tip portion of the corresponding drying arm 2 from the bottom face of the drying arm 2 as is shown in FIG. 1 and is provided with the first clip 4 as described below.

Each second clips 5 is pivoted on the outer upper face of the upper housing 1*b*, so as to be rotatable on the same plane as the drying arm 2 and the auxiliary arm 3. The second clip 5 is made from a resin molding having a predetermined curved portion toward its tip and having predetermined elasticity in the rotation direction.

The drying arms 2 thus mounted on the body 1 are used for hanging the washing A such as washed clothes with their tip portions radially expanding around the body 1 as is shown in the left part of FIG. 1 and FIG. 2. At this point, the first clip 4 and the second clip 5 are elastically in contact with the upper face of the corresponding drying arm 2 at its tip and base portions, respectively, so that each of the washing A is clipped and fixed from the upper side with the first and second clips 4 and 5. Thus, the washing A are prevented from coming off from the drying equipment.

In contrast, the drying arms 2 can be folded with their tip portions collected below the body 1 as is shown in the right part of FIG. 1. When the drying arm 2 is thus folded in the present drying equipment, the tip portion of the auxiliary arm 3 is projected from the tip portion of the drying arm 2, and the first clip 4 disposed at the tip portion of the auxiliary arm 3 and the second clip 5 disposed at the base portion thereof are released from the elastic contact with the drying arm 2. As a result, the washing having been clipped and fixed with the clips 4 and 5 can be naturally dropped down along the drying arm 2 extending with its tip portion downward.

Figure 7:
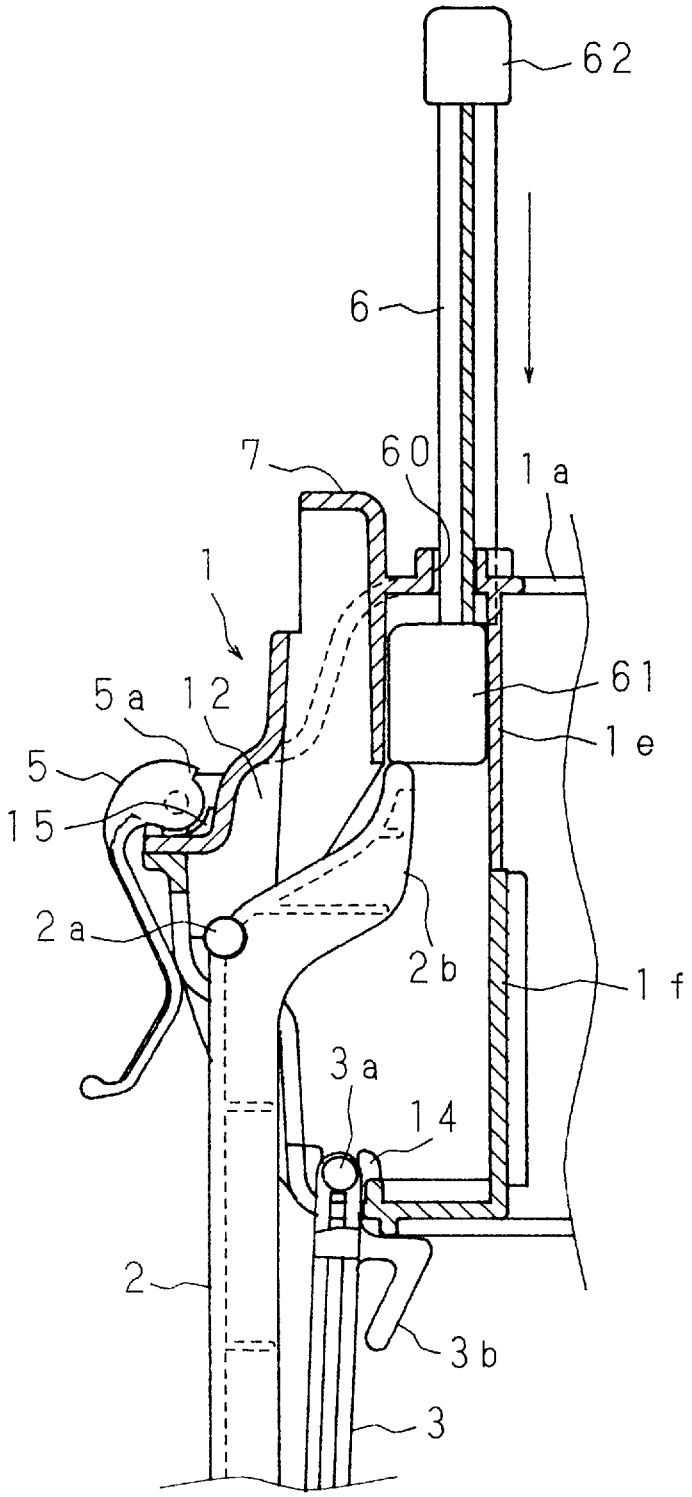
FIG. 7 is an enlarged view of the vicinity of base portions of a drying arm and an auxiliary arm for illustrating their linked operation.
Figure 8:
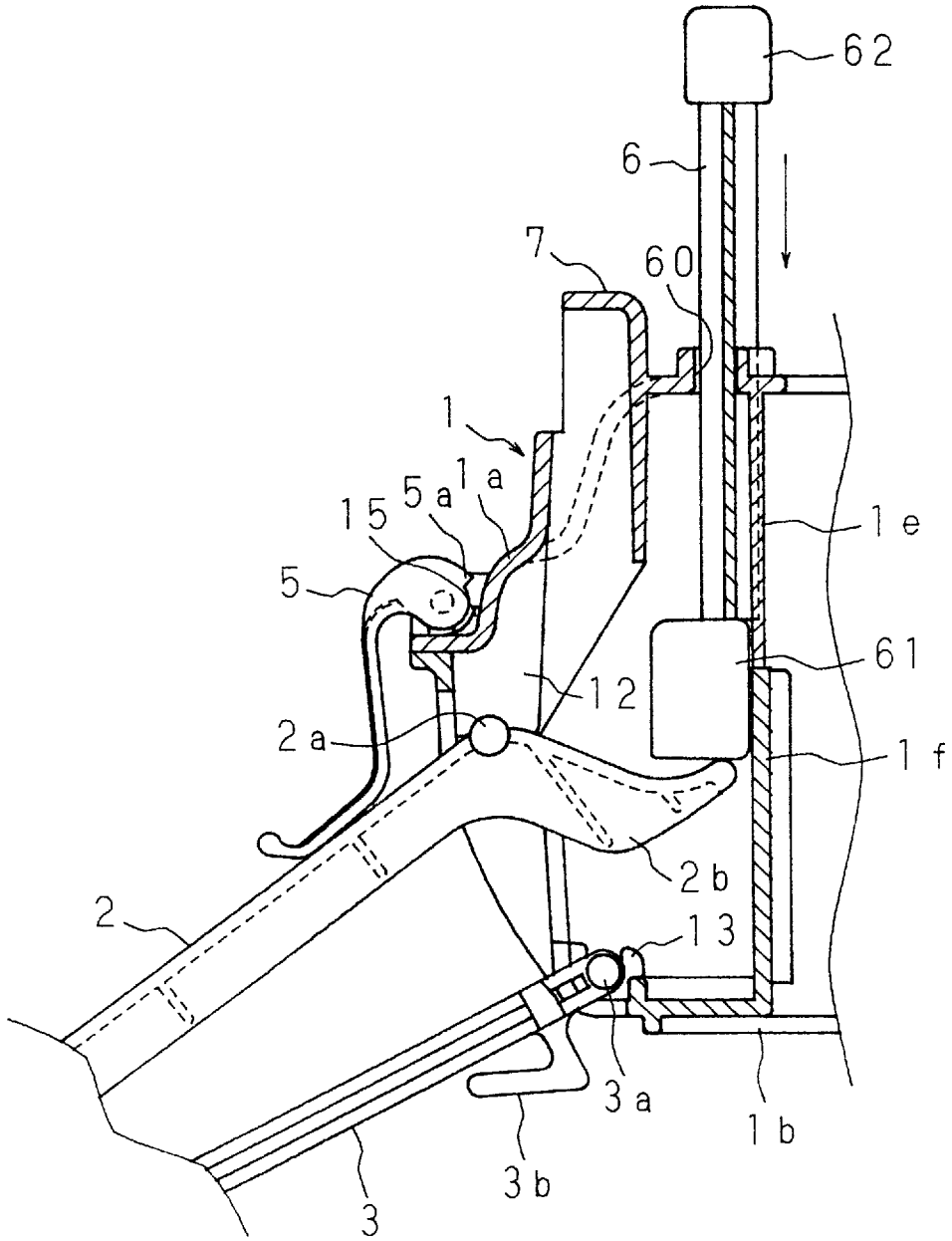
FIG. 8 is another enlarged view of the vicinity of the base portions of the drying arm and the auxiliary arm for illustrating their linked operation.
Figure 9:
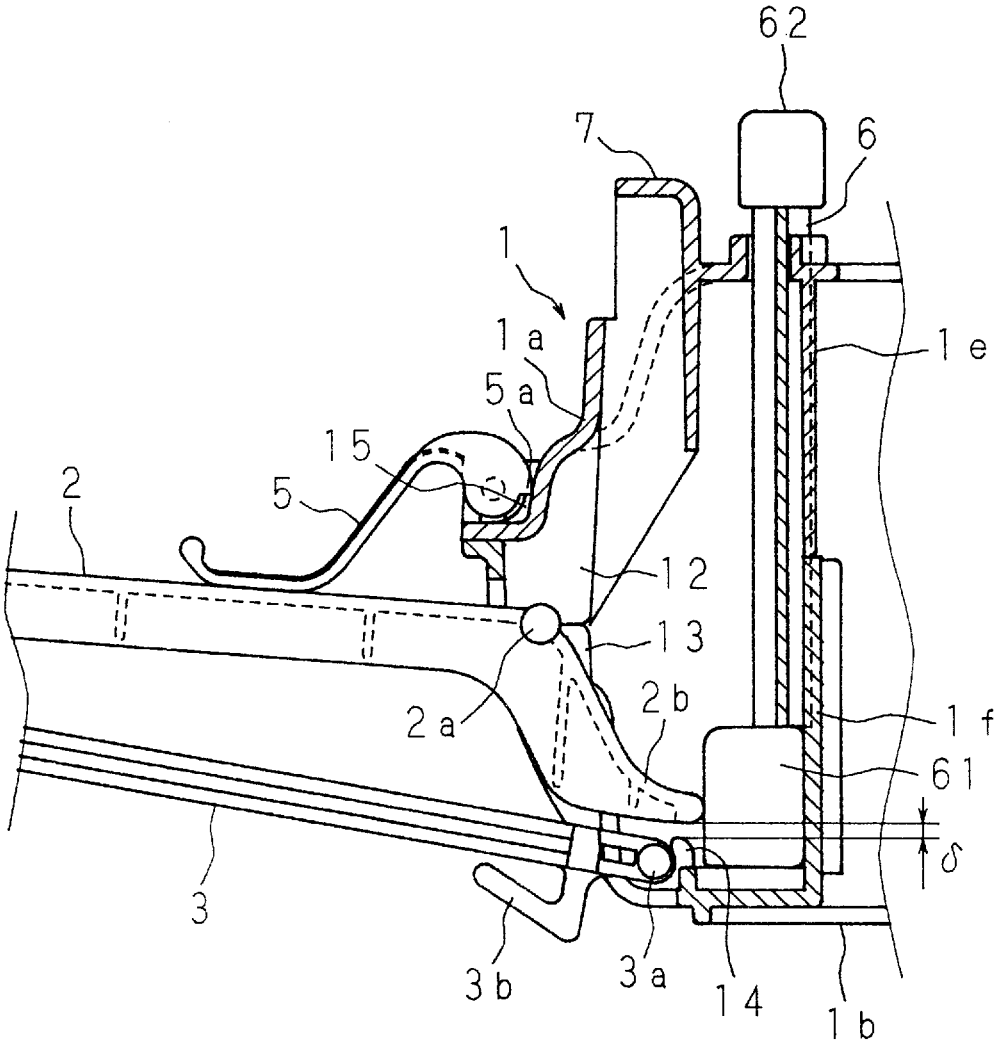
FIG. 9 is still another enlarged view of the vicinity of the base portions of the drying arm and the auxiliary arm for illustrating their linked operation.

FIGS. 7 through 9 are enlarged views of the vicinity of the base portion of the drying arm 2, wherein FIG. 7 shows the folded state where the drying arm 2 is extended downward, FIG. 9 shows the use state where the drying arm 2 is expanded, and FIG. 8 shows an intermediate state between FIGS. 7 and 9.

As is shown in FIG. 9, the extension 2*b* of the drying arm 2 extending toward the inside of the body 1 has a shape bent downward at the position of the pivot 2*a* and further bent toward the inside of the body 1. When the drying arm 2 is folded as is shown in FIG. 7, the extension 2*b* is away from the center of the body 1 by an appropriate distance with its end facing upward. The upper housing 1*a* of the body 1 has an inserting through hole 60 in a position opposing the end of the extension 2*b* facing upward. A push/pull rod 6 is inserted into the inserting through hole 60 slidingly movably in the through hole 60.

On the lower end of the push/pull rod 6 inserted into the body 1, a presser block 61 is fixed, and the upper end of the push/pull rod 6 projecting outside of the body 1 is covered with a cap 62 having a smooth surface. As is shown in FIG. 2, a pair of such push/pull rods 6 are disposed on both sides of the center of the body 1. Each of the presser blocks 61 of these push/pull rods 6 has an arc shape as is shown in FIGS. 2 and 3 correspondingly to the alignment, within the body 1, of the extensions 2*b* of the fifteen drying arms 2. One of the presser block 61 is brought into contact with the extensions 2*b* of the eight drying arms 2 and the other is brought into contact with those of the seven drying arms 2 from the upper side.

When the drying arms 2 are folded as is shown in FIG. 7, the push/pull rod 6 is projected upward because it is pushed upward by the corresponding extensions 2*b* of the drying arms 2 within the body 1. When the push/pull rod 6 in this state is pushed downward as shown with an arrow in FIG. 7, the extensions 2*b* in contact with the presser block 61 within the body 1 are pushed downward, so that the drying arms 2 extending outward from the body 1 are rotated upward as is shown in FIG. 8, namely, rotated so as to expand their tip portions. The rotation can be caused in part of the drying arms 2 by pushing one of the push/pull rods 6 and in all of the drying arms 2 by pushing both the push/pull rods 6.

When the push/pull rod 6 is further pushed so that the extension 2*b* is positioned below the pivot 2*a* as is shown in FIG. 8, the end of the extension 2*b* is moved outward owing to its downward rotation. When the end of the extension 2*b* reaches a point outside of the outer diameter of the presser block 61, the presser block 61 is fit inside of the end of the extension 2*b* as is shown in FIG. 9. Under this condition, the upward rotation of the extension 2*b*, namely, the downward rotation of the drying arm 2, is constrained by the friction between the peripheral face of the presser block 61 and the end of the extension 2*b*. As a result, the drying arm 2 can be definitely constrained in the use state where the drying arm 2 is expanded around the body 1.

On the upper housing 1*a* of the body 1, fingering parts 7 each having a face for catching a finger in the upward direction are formed on the outer sides of the through hole 60. The pushing operation of the push/pull rods 6 for expanding the drying arms 2 can be easily conducted by using the fingers caught by the fingering parts 7 as supports.

During the usage of the drying equipment with the drying arms 2 thus constrained, the washing A hung on each of the drying arms 2 apply a downward load to the drying arm 2, and the end of the corresponding extension 2*b* in contact with the presser block 61 within the body 1 is supplied with an upward force in accordance with the load. However, the aforementioned constraint can be definitely retained without being affected by the upward force.

Figure 10:
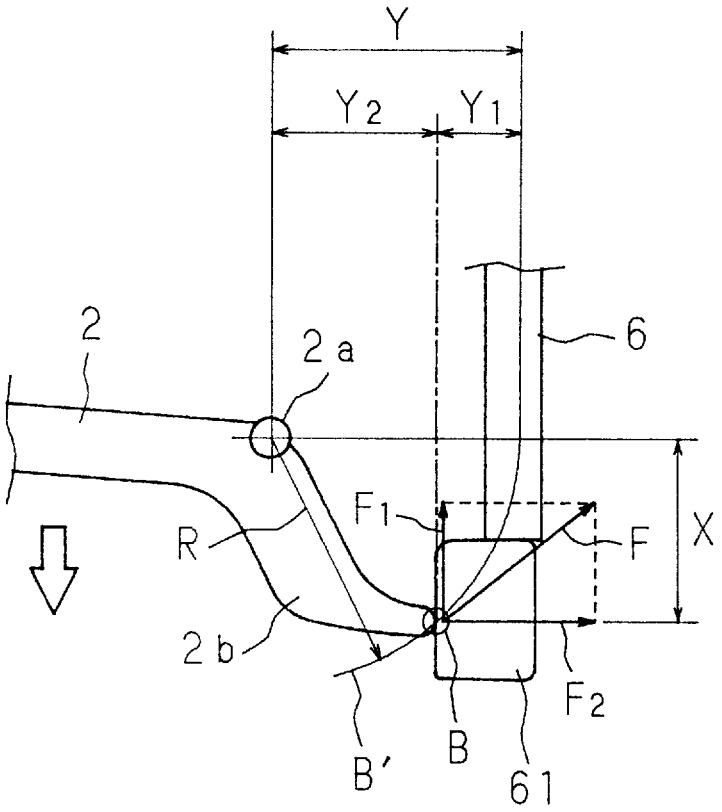
FIG. 10 illustrates constraint of a drying arm in an expanded state.

FIG. 10 shows the constraining operation of the expanded drying arm 2. When the downward load is applied to the drying arm 2 as is shown with a white arrow in FIG. 10, the end B of the extension 2*b* of the drying arm 2 in contact with the peripheral face of the presser block 61 is supplied with a force F, corresponding to the load, in a tangential direction of an arc-like rotation orbit B' of the end B with the pivot 2*a*, i.e., the rotation center of the drying arm 2, as the rotation center. Therefore, the extension 2*b* is to be pulled upward owing to the function of a first component force $F_1$ of the force F in the direction along the contact face with the presser block 61.

However, at this point, a second component force $F_2$ in the perpendicular direction to the first component force $F_1$ is also applied to the end B in a direction for enforcing the press toward the presser block 61. Since the second component force $F_2$ is increased as the force F corresponding to the load applied to the drying arm 2 is increased, the press of the end B toward the peripheral face of the presser block 61 is enforced in accordance with the increase of the load. Therefore, the constraint of the drying arm 2 can be definitely retained. This can be realized because the end B of the extension 2*b* in contact with the presser block 61 is set to be positioned below the pivot 2*a*, i.e., the rotation center of the drying arm 2.

When the constraint is to be released in order to fold the drying arms 2 for taking the washing A in, the constraint can be released by applying a force in the reverse direction to the load applied to the drying arms 2 during the usage, namely, an upward force. The upward force can be applied to the plural drying arms 2 at a time by, for example, while grasping the body 1 for supporting the base portions of the drying arms 2 by gripping the suspending part 10, lowering the body 1 and suddenly stopping it immediately after lowering or lowering the body 1 and pulling it upward after lowering.

Figure 11:
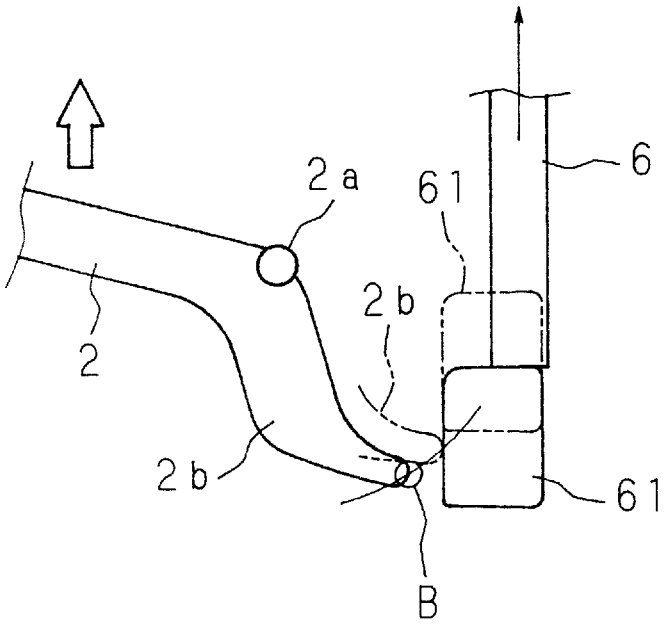
FIG. 11 illustrates release of the constraint of the drying arm.

FIG. 11 shows the constraint releasing operation for the drying arm 2. In conducting the above-described operation, as a result of the sudden stop or pulling upward after lowering the body 1, the drying arm 2 is supplied with an inertia force of the washing A hung thereon in the upward direction as is shown with a white arrow in FIG. 11. Accordingly, the drying arm 2 is rotated in a direction for elevating its tip portion, namely, in the direction for lowering the extension 2*b* at the base portion thereof. When the drying arm 2 is expanded, there retains an appropriate gap δ (see FIG. 9) between the lower face of the extension 2*b* and the bottom of the lower housing 1*b* of the body 1. Therefore, the drying arm 2 can be rotated downward within the gap δ.

The end B of the extension 2*b* in contact with the presser block 61 has an arc-like shape as is shown in FIG. 11 on the rotation plane of the drying arm 2 with the pivot 2*a* as the rotation center, and is in point-contact with the peripheral face of the presser block 61. When the extension 2*b* is rotated in the downward direction owing to the function of the inertia force, the end B can be freely moved away from the peripheral face of the presser block 61. The drying arm 2 and the extension 2*b* have a predetermined width, and hence the end B is in point-contact with the presser block 61 continuously in the widthwise direction. Therefore, the contact between the end B and the presser block 61 is precisely line-contact resulting from the continuous point-contact in the widthwise direction.

The upward inertia force caused by the above-described operation is also applied to the presser block 61 constrained by the contact with the end B, and hence, the presser block 61 is moved upward together with the push/pull rod 6 as the end B is moved away therefrom.

The rotation of the drying arm 2 caused by the function of the inertia force is momentarily caused at the time of conducting the above-described operation. Then, the drying arm 2 is rotated downward due to its own weight and the load of the washing A hung thereon. However, as is shown with two-dot chain lines in FIG. 11, when the extension 2*b* returns to its original position as a result of the rotation, the presser block 61 having occupied that position has moved upward as is shown with the two-dot chain line. Thus, as a result of the further rotation, the end B of the extension 2*b* is brought into contact with the bottom face of the presser block 61, and is further rotated while pushing the presser block 61 upward. As a result, the drying arm 2 can be folded as is shown in the right part of FIG. 1 and FIG. 7.

Figure 12B:
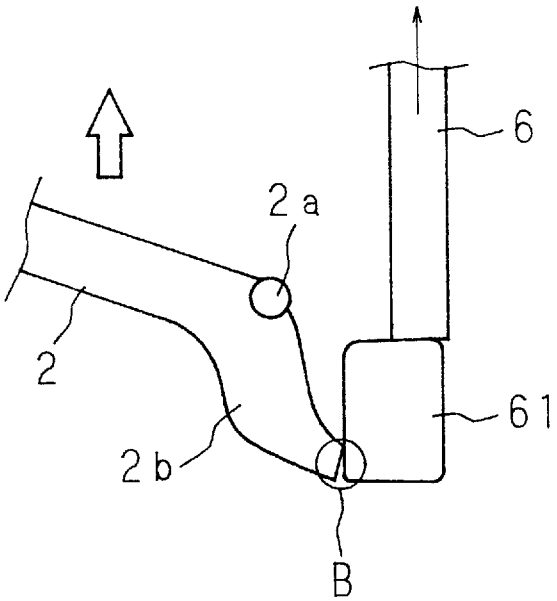
FIGS. 12A and 12B illustrate an operation of an extension of a drying arm provided with a flat face on a contact end.
Figure 12A:
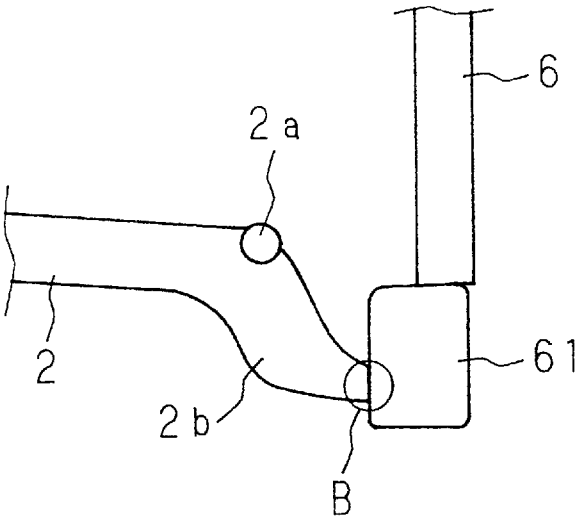

FIGS. 12A and 12B illustrate the constraint releasing operation conducted in the case where the end B of the extension 2*b* is provided with a flat face. In the case where the above-described operation is conducted in the constraint state shown in FIG. 12A, so that the upward inertia force is applied to the drying arm 2, the extension 2*b* of the drying arm 2 is rotated downward. At this point, the upper edge of the flat face of the end B butts against the peripheral face of the presser block 61 as is shown in FIG. 12B, so that the presser block 61 is prevented from moving upward. Accordingly, when the extension 2*b* returns to its original position thereafter, the extension 2*b* is merely brought into the constrained state again, and the drying arm 2 cannot be folded as described above.

Therefore, in order to fold the drying arms 2 at a time by lowering the body 1 for supporting the base portions of the drying arms 2 and suddenly stopping it or pulling it upward immediately after as described above, the end B of the extension 2*b* in contact with the presser block 61 is required to have the arc-like shape on the rotation plane of each drying arm 2 with the pivot 2*a* as the rotation center, so as to be in point-contact with the peripheral face of the presser block 61.

The drying arms 2 can be folded by conducting another operation, for example, by directly applying an upward force to the tip portion of each drying arm 2 with a hand of a user. However, in such a case, the push/pull rod 6 is required to be pulled upward in the body 1 at the same time. Therefore, such an operation is inferior in the easiness as compared with the aforementioned operation for lowering the body 1.

Furthermore, the present inventors have found the following: It is necessary to appropriately set a vertical level difference X (see FIG. 10) between the pivot 2*a* and the end B of the extension 2*b* in contact with the presser block 61 in order to conduct the above-described operation for folding the drying arms 2 definitely without harmfully affecting the constraint of the drying arms 2 during the usage.

When the level difference X is too large, although the operation for folding the drying arms 2 can be easily conducted, the drying arms 2 cannot be securely constrained during the usage. Therefore, the drying arms 2 can be folded by a small external force such as a wind, so that the washing A hung on the drying arms 2 can be dropped. In contrast, when the level difference X is too small, a large force is required to fold the drying arms 2, which can degrade the convenience.

The appropriate value of the level difference X depends upon the entire dimension of the drying equipment and cannot be uniformly defined. However, the value can be limited to the following range:

$$0.55R<X<0.85R \quad (1)$$

wherein R indicates a radius of the rotation of the end B of the extension 2*b* with the pivot 2*a* as the rotation center.

When the level difference X is set to satisfy the above range (1), not only the drying arms 2 can be prevented from being released from the constraint due to a possible external force applied in error during the usage so as to prevent the washing A from coming off, but also the drying arms 2 can be easily folded. Thus, the drying equipment can attain excellent convenience.

The optimal value of the level difference X is a rather large value within the range (1). Specifically, when the rotation radius R is 45.4 mm, the level difference X of 34 mm (=0.75R) can achieve a satisfactory effect. At this point, a distance Y in the horizontal direction between the pivot 2*a* and the rotation orbit B' of the end B farthest from the pivot 2*a* and an overlapping length $Y_1$ of this rotation orbit B' on the peripheral face of the presser block 61 (see FIG. 10) are both uniquely defined. Specifically, in the above-mentioned example, Y=R=45.4 mm and $Y_1$=16.7 mm.

In the second clip 5 pivoted on the drying arm 2 at its base portion, the tip comes in contact with the upper face of the drying arm 2 as the drying arm 2 is expanded, and the second clip 5 is rotated in accordance with the further rotation of the drying arm 2. The rotation of the second clip 5 is constrained by engaging an engaging claw 5*a* projected from the outer face of the pivoted position thereof with a recess 15 formed in the corresponding position on the upper housing 1*a*. The second clip 5 is thus constrained before the drying arm 2 is completely expanded. In this manner, the second clip 5 is elastically in contact with the upper face of the expanded drying arm 2 owing to the elasticity of its tip, so that the washing A hung on the drying arm 2 can be clipped and fixed near the base portion of the drying arm 2 as described above.

The auxiliary arm 3 pivoted below each drying arm 2 is inserted through the drying arm 2 at its tip portion, so as to be rotatable with the inserted portion as the support in accordance with the rotation of the drying arm 2. At this point, since the drying arm 2 and the auxiliary arm 3 have the pivots in different positions, the auxiliary arm 3 is rotated with relative movement in the lengthwise direction of the drying arm 2. Owing to this rotation of the auxiliary arm 3, the tip portion of the auxiliary arm 3 goes out and draws back at the tip portion of the drying arm 2. The base portion of the auxiliary arm 3 is provided with a small hook 3*b* so as to face downward during the usage of the drying equipment. This small hook 3*b* can be used to catch a small article such as a shoe string and a handkerchief.

Figure 13A:
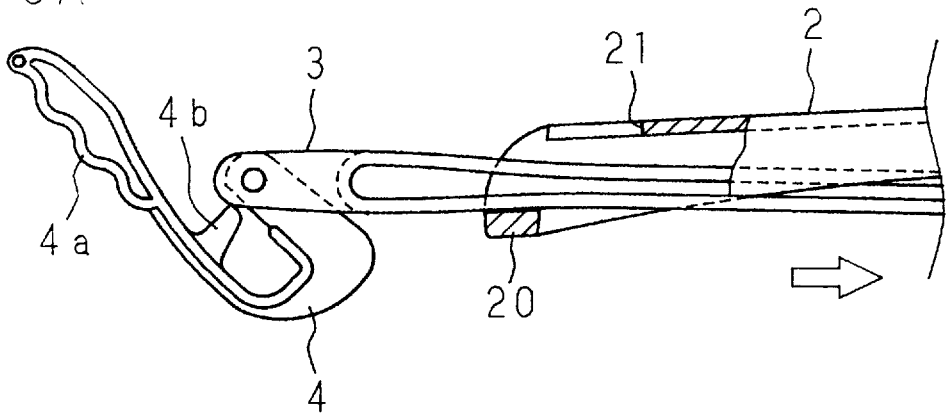
FIGS. 13A, 13B and 13C are enlarged views of the vicinity of tip portions of a drying arm and an auxiliary arm for illustrating their linked operation.
Figure 13B:
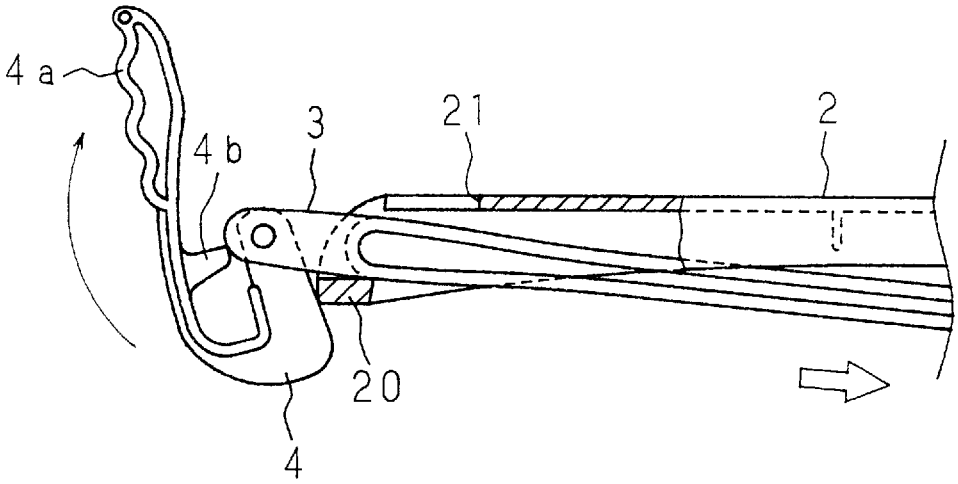
Figure 13C:
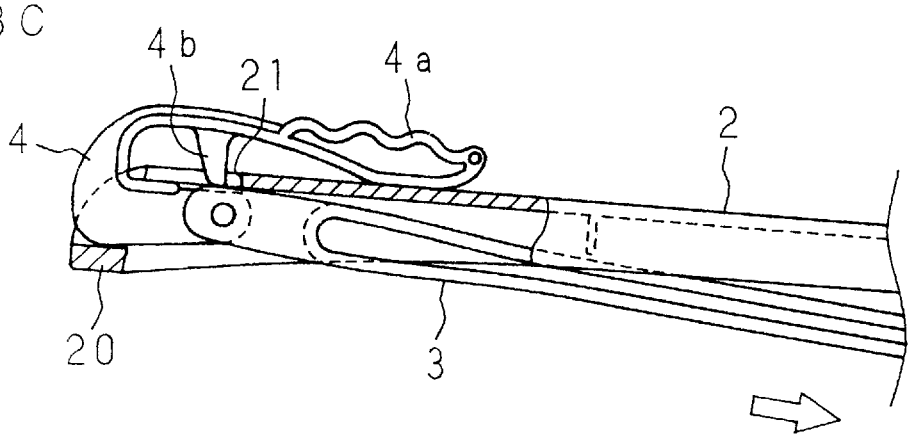

FIGS. 13A, 13B and 13C are enlarged views around the tip portion of the drying arm 2, wherein FIG. 13A shows the folded state where the drying arm 2 and the auxiliary arm 3 are vertically extended below the body 1, FIG. 13C shows the use state where the drying arm 2 and the auxiliary arm 3 are expanded, and FIG. 13B shows an intermediate state between FIGS. 13A and 13C.

The tip portion of the drying arm 2 has a reverse U-shaped section with its opening facing downward, and is provided with a cross-beam 20 for connecting the two sides of the U-shape, so as to form a guide portion having a rectangular section. The auxiliary arm 3 is inserted through the guide portion and is supported by the cross-beam 20 at its lower face, so as to be slidable in the lengthwise direction.

The first clip 4 has substantially a U-shape, and is made from a resin molding having predetermined elasticity against a force to open the sides of the U-shape. The first clip 4 is pivoted on the branched tip of the auxiliary arm 3 at its one end, so as to be rotatable on the same plane as the auxiliary arm 3 and the drying arm 2. The portion communicated with the other end of the first clip 4 has a larger length than the portion close to the pivoted end, and has a larger thickness so as to have a larger weight, thereby forming a clip portion 4*a*.

When the drying arm 2 is folded as is shown in FIG. 13A, the tip portion of the drying arm 2 is actually facing downward, and the tip portion of the auxiliary arm 3 pivoted in the lower position than the drying arm 2 is projected from the tip portion of the drying arm 2. During the rotation to expand the drying arm 2 and to attain the state shown in FIG. 13C, the auxiliary arm 3 goes back toward its base portion as is shown with a white arrow, so that the tip portion of the auxiliary arm 3 can be guided along the guide portion and drawn into the tip portion of the drying arm 2.

The first clip 4 pivoted at the tip portion of the auxiliary arm 3 is in a position where the clip portion 4*a* with the larger weight is positioned below (on the left side in FIGS. 13A through 13C) the auxiliary arm 3 when the drying arm 2 is folded as shown in FIG. 13A. In accordance with the backward movement of the auxiliary arm 3 linked with the expansion of the drying arm 2, the first clip 4 is drawn into the guide portion from its end connected with the auxiliary arm 3. While being drawn, the first clip 4 is in contact with the cross-beam 20 as is shown in FIG. 13B. Thereafter, the portion of the first clip 4 in contact with the cross-beam 20 is pressed as the first clip 4 is further drawn, so as to be rotated as is shown with an arrow in FIG. 13B. Then, when the use state shown in FIG. 13C is attained, a predetermined length of the first clip 4 closer to the auxiliary arm 3 is drawn into the drying arm 2, and the clip portion 4*a* farther from the auxiliary arm 3 is in elastic contact with one face (upper face) of the drying arm 2. Thus, the first clip 4 can be used for clipping and fixing the washing A hung on the drying arm 2 at its tip portion.

On the inner face of the clip portion 4*a,* a guide rod 4*b* is projected at a substantially center in the widthwise direction toward the opposing portion of the first clip 4. On the upper face of the tip portion of the drying arm 2, a guide groove 21 having a width corresponding to the width of the guide rod 4*b* is formed at a substantially center in the widthwise direction. Thus, the first clip 4 is drawn in accordance with the backward movement of the auxiliary arm 3 without causing positional shift in the widthwise direction because the guide rod 4*b* can be fit in the guide groove 21 as is shown in FIG. 13C. The relationship between the guide rod 4*b* and the guide groove 21 will be apparent from FIG. 15 described below.

When the constraint of the drying arm 2 in use is released and the drying arm 2 is rotated in the reverse direction to the expanding direction, the state of the tip portion of the drying arm 2 is changed from that shown in FIG. 13C to that shown in FIG. 13A. Specifically, the auxiliary arm 3 is pushed out from the tip portion of the drying arm 2, and the elastic contact of the first clip 4 is released so that the first clip 4 is rotated by its own weight. Then, the first clip 4 attains the state having the opening of the U-shape facing downward (leftward in FIGS. 13A through 13C) as is shown in FIG. 13A. As a result, the washing A having been hung on the drying arm 2 as is shown in the left part of FIG. I is naturally dropped by its own weight.

In this manner, in the present drying equipment, when the drying arms 2 having been expanded are rotated by the aforementioned folding operation, the pressure applied by the first clips 4 disposed at the tip portions of the drying arms 2 is released in accordance with the rotation of the drying arms 2. Furthermore, the pressure applied by the second clips 2 disposed at the base portions of the drying arms 2 is also released. Accordingly, when the washing A hung on the drying arms 2 are to be taken in, the user is merely required of conducting the aforementioned operation for folding the drying arms 2. As a result, the washing A are naturally dropped by their own weights and can be easily taken in.

Figure 14A:
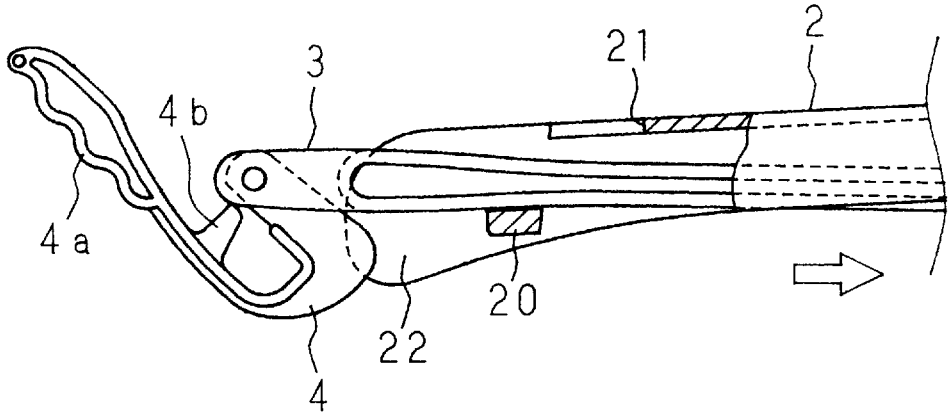
FIG. 14A, 14B and 14C are enlarged views of the vicinity of improved tip portions of the drying arm and the auxiliary arm for preventing the washing from being caught by a first clip.
Figure 14B:
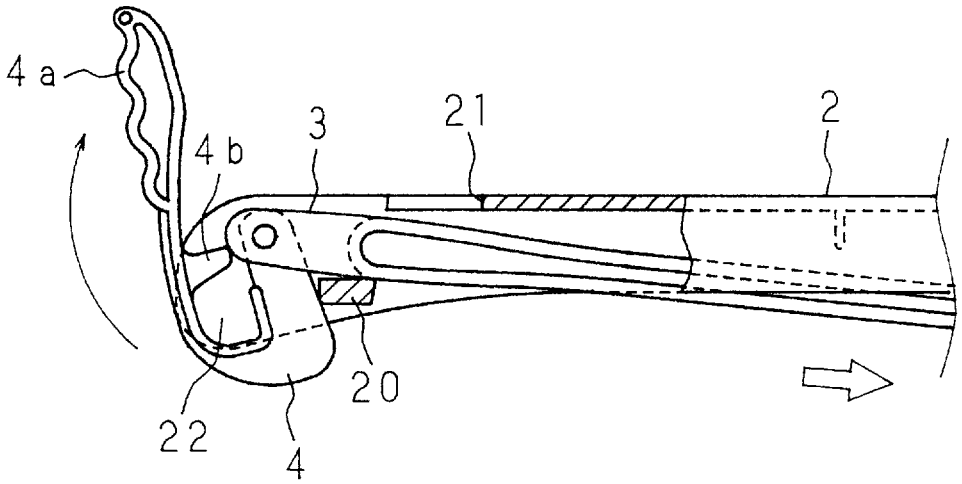
Figure 14C:
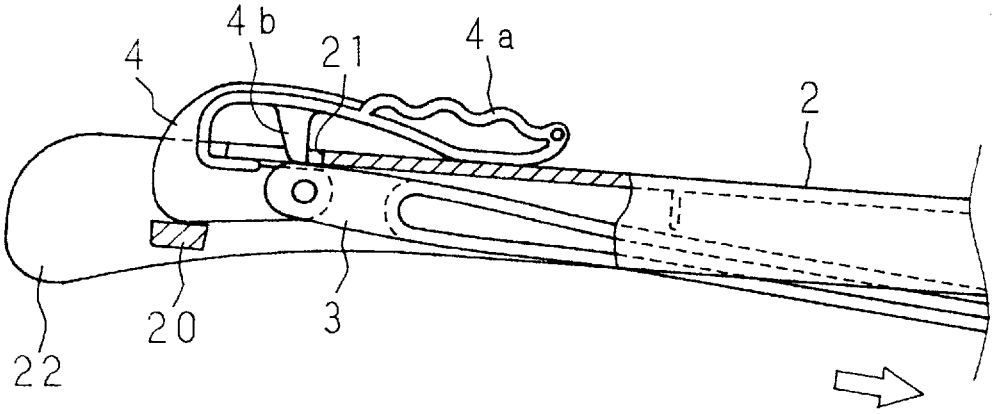
Figure 15:
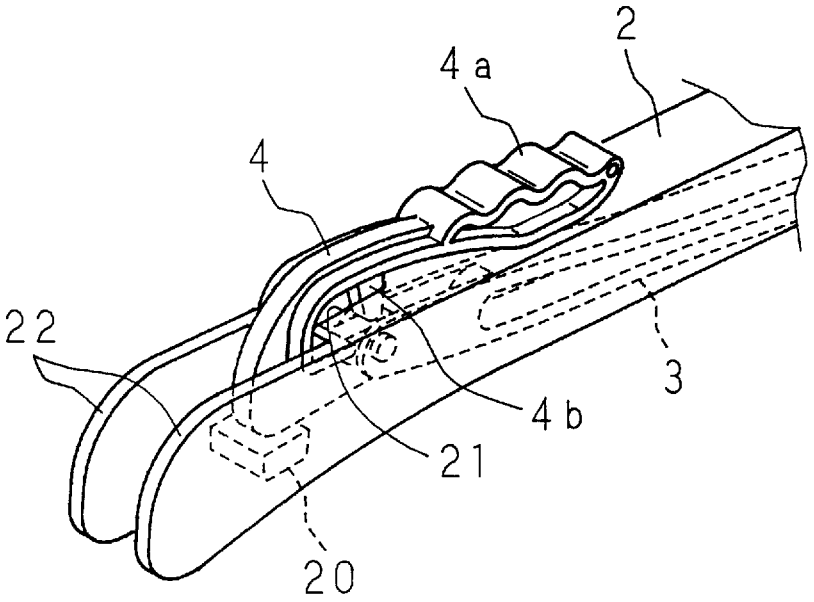
FIG. 15 is a perspective view of the vicinity of the improved tip portions.

The washing A is dropped down along each drying arm 2. At this point, the washing A can be caught by the first clip 4 rotating at the tip portion of the drying arm 2 and can be prevented from dropping. FIGS. 14A, 14B, 14C and 15 show improvement of the tip portion of the drying arm 2 for overcoming this problem. FIGS. 14A, 14B and 14C are enlarged views for showing the folding operation, and FIG. 15 is a perspective view of the vicinity of the improved tip portion of the drying arm 2.

In these drawings, the tip portion of the drying arm 2 is provided with a covering portion 22 for covering an area on both sides of the pivoted position of the first clip 4 extending over the entire range of the back-and-forth movement of the auxiliary arm 3. As is shown in FIG. 15, the covering portion 22 is formed by extending outward the side faces of the U-shaped drying arm 2 in the lengthwise direction, so that the rotation of the first clip 4 shown in FIGS. 14A, 14B and 14C can be effected within the area covered with the covering portion 22. Therefore, while the washing A is being dropped along the drying arm 2, the both sides of the first clip 4 are covered with the covering portion 22, so that the washing A is scarcely caught by the first clip 4 in dropping along the drying arm 2. As a result, the washing A can be definitely dropped in accordance with the folding operation for the drying arms 2, and the washing A can be conveniently and easily taken in.

As described above, in the present drying equipment, in liaison with the operation for folding plural drying arms radially expanded around the body, the pressure applied by the clips at the tip portions of the drying arms can be released, so that the inconvenience in taking in the washing can be overcome. Furthermore, since the tip portion of each drying arm is provided with the covering portion for covering the sides of the pivoted position of the clip, the washing can be definitely dropped merely by folding the drying arms.

Moreover, since the means for expanding the drying arms, constraining them in the expanded state and folding them is provided on the body, the drying arms can be folded at a time and the washing can be more easily taken in. In addition, the drying arms can be definitely expanded at a time, so as to easily attain the use state. Furthermore, the drying arms are constrained by locating the point-contact of the extension at the base portion of each drying arm with one face of the presser block in the position away from the pivot of the drying arm by the predetermined level difference in the vertical direction. Accordingly, the constraint can be easily and definitely released.

Moreover, since the drying equipment is provided with the second clip in an elastic contact with each of the expanded drying arms, the washing hung on the drying arm and clipped with the clip at the tip portion can be definitely fixed, and can be effectively prevented from dropping from the drying arm due to a wind.

Additionally, since the suspending part disposed at the center of the body is provided with the clasping parts and the catching portion, the drying equipment can be hung on various objects for suspension. Furthermore, since the suspending part is removably provided together with the supporting part for rotatably supporting the suspending part, the drying equipment can be easily hung for use, and the suspending part, which can be damaged due to a load applied during the suspension, is advantageously replaceable.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

I claim:

1. Drying equipment, comprising:

a body having a suspending part disposed at substantially a center of one face thereof for suspending the body on an object for suspension with the face facing upward;

at least one drying arm disposed on a periphery of the body, each drying arm including a base portion and a tip portion and being radially operable between a first position and a second position;

a clip disposed at the tip portion of each drying arm operable between an open state and a clipping state; and constraining means, operably connected to each of the at least one drying arm, for moving each corresponding clip into the clipping state as each corresponding at least one drying arm is moved from the first position into the second position and for releasing each corresponding clip to the open state as each corresponding at least one drying arm is moved from the second position into the first position.

2. The drying equipment according to claim 1, wherein the constraining means includes an auxiliary arm having a base portion connected to the periphery of the body at a position lower than the at least one drying arm and having a tip portion inserted through a guide portion formed at the tip portion of the at least one drying arm, the clip being disposed with one end thereof on the tip portion of the auxiliary arm, and each auxiliary arm is rotated on the same plane as the corresponding at least one drying arm and moved in a lengthwise direction in accordance with the rotation of the corresponding at least one drying arm, the clip is drawn into the guide portion and brought into elastic contact with the tip portion of the drying arm when the corresponding at least one drying arm moves into the first position, and the clip is pushed out of the guide portion and released when the corresponding at least one drying arm moves into the second position.

3. The drying equipment according to claim 1, wherein the body includes operating means for moving one or all of the drying arms at a time into the first and second positions.

4. The drying equipment according to claim 1, further comprising:

a second clip disposed at the periphery of the body and brought into elastic contact with each of the drying arms as the drying arm is moved into the first position.

5. The drying equipment according to claim 1, wherein the suspending part includes:

a fixed clasping member mounted on the body;

a movable clasping member pivoted at a halfway thereof on the fixed clasping member; and pressing means for pressing one side of the movable clasping member toward a tip of the fixed clasping member so that the object for suspension is grasped between the clasping members opened against a pressure applied by the pressing means.

6. The drying equipment according to claim 2, wherein the body includes operating means for moving one or all of the drying arms at a time into the first and second positions.

7. The drying equipment according to claim 2, wherein each of the drying arms has a covering portion disposed at the tip portion thereof for covering an area on both sides of a pivoted position of the clip extending over an entire range of movement of the corresponding auxiliary arm in the lengthwise direction.

8. The drying equipment according to claim 3, wherein each of the drying arms includes a pivot and an extension extended from the pivot thereof into the body, the operation means includes a push/pull rod penetrating through an upper portion of the body and extending into the body and a presser block fixed at an end of the push/pull rod within the body and being in contact with the extensions of the drying arms aligned within the body, and the drying arms are expanded in an upward direction by pressing the extensions of the drying arms in a downward direction through the presser block by pushing the push/pull rod, and when the drying arms are expanded to be located in predetermined positions, the presser block is fit between ends of the extensions of the drying arms, thereby constraining the drying arms by using friction between the ends of the extensions and a peripheral face of the presser block.

9. The drying equipment according to claim 5, wherein the movable clasping member is provided with a catching portion for catching the object for suspension.

10. The drying equipment according to claim 5, wherein the suspending part is removably mounted on the body through a supporting part for axially rotatably supporting a ground portion of the fixed clasping member.

11. The drying equipment according to claim 6, wherein each of the drying arms includes a pivot and an extension extended from the pivot thereof into the body, the operation means includes a push/pull rod penetrating through an upper portion of the body and extending into the body and a presser block fixed at an end of the push/pull rod within the body and being in contact with the extensions of the drying arms aligned within the body, and the drying arms are expanded in an upward direction by pressing the extensions of the drying arms in a downward direction through the presser block by pushing the push/pull rod, and when the drying arms are expanded to be located in predetermined positions, the presser block is fit between ends of the extensions of the drying arms, thereby constraining the drying arms by using friction between the ends of the extensions and a peripheral face of the presser block.

12. The drying equipment according to claim 8, wherein the end of the extension of each drying arm has an arc-like shape on a plane of rotation thereof with the pivot as the rotation center and is in point-contact with a corresponding face of the presser block.

13. The drying equipment according to claim 11, wherein the end of the extension of each drying arm has an arc-like shape on a plane of rotation thereof with the pivot as the rotation center and is in point-contact with a corresponding face of the presser block.

14. The drying equipment according to claim 11, further comprising a second clip disposed at the periphery of the body and brought into elastic contact each of the drying arms as the drying arm is moved into the first position.

15. The drying equipment according to claim 12, wherein a contact point between the end of the extension of each drying arm and the presser block is located below the pivot of the drying arm, and a level difference X between the pivot and the contact point is set to satisfy the following relationship:

$$0.55R<X<0.85R$$

wherein R indicates a radius of the rotation of the end of the extension with the pivot as the rotation center.

16. The drying equipment according to claim 13, wherein a contact point between the end of the extension of each drying arm and the presser block is located below the pivot of the drying arm, and a level difference X between the pivot and the contact point is set to satisfy the following relationship:

$$0.55R<X<0.85R$$

wherein R indicates a radius of the rotation of the end of the extension with the pivot as the rotation center.

17. The drying equipment according to claim 13, wherein the suspending part includes:

a fixed clasping member mounted on the body;

a movable clasping member pivoted at a halfway thereof on the fixed clasping member; and pressing means for pressing one side of the movable clasping member toward a tip of the fixed clasping member, and the object for suspension is grasped between the clasping members opened against a pressure applied by the pressing means.

18. The drying equipment according to claim 17, wherein the movable clasping member is provided with a catching portion for catching the object for suspension.

19. The drying equipment according to claim 17, wherein the suspending part is removably mounted on the body through a supporting part for axially rotatably supporting a ground portion of the fixed clasping member.

20. Drying equipment, comprising:

a body having a suspending part disposed at substantially a center of one face thereof, the suspending part including, a fixed clasping member mounted on the body;

a movable clasping member pivotally attached to the fixed clasping member; and a pressing element for pressing one side of the movable clasping member toward the fixed clasping member so that an object for suspension is grasped between the clasping members opened against a pressure applied by the pressing element, the pressing element including a gripping element for suspending the body on a object for suspension having a stepped surface;

at least one drying arm disposed on a periphery of the body, each drying arm including a base portion and a tip portion and being radially operable between a first position and a second position; and a clip disposed at the tip portion of each drying arm operable between a clipping state and an open state.

21. Drying equipment, comprising:

a body having a suspending part disposed at substantially a center of one face thereof;

at least one drying arm disposed on a periphery of the body, each drying arm including a base portion and a tip portion and being radially operable between a first position and a second position;

a clip disposed at the tip portion of each drying arm operable between an open state and a clipping state; and a constraining element, operably connected to each of the at least one drying arm, for moving each corresponding clip into the clipping state as each corresponding at least one drying arm is moved from the first position into the second position and for releasing each corresponding clip to the open state as each corresponding at least one drying arm is moved from the second into the first position.

22. Drying equipment, comprising:

a body;

at least one drying arm disposed on a periphery of the body, each drying arm being radially operable between a first position and a second position; and operating means, disposed on the body, for moving each drying arm from the first position into the second position, the operating means including a presser block slidably operable within the body between a releasing state and a fixing state, each drying arm being moved from the first position into the second position as the presser block is operated from the releasing state into the fixing state.

* * * * *